US008832887B2

(12) United States Patent
Mossbeck

(10) Patent No.: US 8,832,887 B2
(45) Date of Patent: Sep. 16, 2014

(54) ANTI-SNORE BED HAVING INFLATABLE MEMBERS

(71) Applicant: L&P Property Management Company, South Gate, CA (US)

(72) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 13/953,127

(22) Filed: Jul. 29, 2013

(65) Prior Publication Data

US 2014/0047644 A1 Feb. 20, 2014

Related U.S. Application Data

(60) Provisional application No. 61/684,860, filed on Aug. 20, 2012.

(51) Int. Cl.
*A47C 27/08* (2006.01)
*A47C 27/10* (2006.01)

(52) U.S. Cl.
CPC ..... *A47C 27/083* (2013.01); *A47C 27/10* (2013.01)
USPC ..... 5/713; 5/710; 5/715

(58) Field of Classification Search
USPC ..... 5/607–609, 612, 613, 615, 616, 706, 5/710, 713, 715
See application file for complete search history.

(56) References Cited

U.S. PATENT DOCUMENTS

| | | | | |
|---|---|---|---|---|
| 3,013,281 | A | 12/1961 | Steiner | |
| 3,089,130 | A | 5/1963 | Wilson | |
| 3,485,240 | A * | 12/1969 | Fountain | 601/148 |
| 4,788,533 | A | 11/1988 | Mequignon | |
| 4,848,360 | A | 7/1989 | Palsgard et al. | |
| 4,941,221 | A * | 7/1990 | Kanzler | 5/615 |
| 5,042,097 | A | 8/1991 | Fuchs | |
| 5,092,007 | A * | 3/1992 | Hasty | 5/715 |
| 5,105,488 | A | 4/1992 | Hutchinson et al. | |
| 5,113,539 | A | 5/1992 | Strell | |
| 6,098,223 | A | 8/2000 | Larson | |
| 6,386,201 | B1 | 5/2002 | Fard | |
| 6,986,182 | B2 | 1/2006 | Mossbeck | |
| 7,388,507 | B2 | 6/2008 | Bader | |
| 7,418,751 | B1 * | 9/2008 | Bartlett et al. | 5/609 |
| 7,464,422 | B2 * | 12/2008 | Townsend | 5/615 |
| 7,513,003 | B2 * | 4/2009 | Mossbeck | 5/731 |
| 7,835,529 | B2 | 11/2010 | Hernandez et al. | |
| 2006/0162074 | A1 * | 7/2006 | Bader | 5/421 |
| 2009/0250070 | A1 * | 10/2009 | Pfeifer | 128/848 |
| 2010/0283618 | A1 * | 11/2010 | Wolfe et al. | 340/575 |
| 2010/0302044 | A1 * | 12/2010 | Chacon et al. | 340/575 |

FOREIGN PATENT DOCUMENTS

| | | |
|---|---|---|
| DE | 1198005 | 8/1965 |
| DE | 4137631 | 5/1992 |
| WO | 8603663 | 7/1986 |

*Primary Examiner* — Nicholas Polito
*Assistant Examiner* — Richard G Davis
(74) *Attorney, Agent, or Firm* — Wood, Herron & Evans, LLP

* cited by examiner

(57) ABSTRACT

A bedding product (5) comprises a mattress (10) and padding (20) and an inflatable bladder assembly (30). The bedding product (5) may have a plurality of inflatable members (31, 32) located underneath select portions of the padding (20). The bedding product (5) may have a sensor (41) adapted to detect a sound associated with human snoring and an air supply system (50) operatively coupled to the sensor (41) and adapted to control a supply of air to one of the inflatable members (31, 32).

27 Claims, 6 Drawing Sheets

ANTI-SNORE BED HAVING INFLATABLE MEMBERS

CROSS-REFERENCE TO RELATED APPLICATIONS

This application claims the benefit of U.S. Provisional Patent Application Ser. No. 61/684,860, which is fully incorporated herein.

FIELD OF THE INVENTION

The present invention relates generally to bedding products. More specifically, it is directed to a bed adapted to stop the snoring of one or more persons sleeping thereon.

BACKGROUND OF THE INVENTION

Various ways have been developed to prevent snoring. Snoring may disturb persons sleeping in the same room or on the same bed as the person snoring. From time to time, snoring can become so loud that it may even awaken the snoring person or others in the same room or bed. Some may deal with a snorer by waking him/her up to cause the snoring to stop, but this causes the snorer's sleep to be interrupted. Furthermore, after going back to sleep, snoring may start again, often shortly afterwards.

Snoring may occur when soft tissue in the back of a person's mouth relaxes during sleep, especially when a person sleeps on his or her back. The relaxation of the tissue may partially block the airway, which causes the body of the person to react by breathing harder, which in turn causes vibration of the tissue that results in a snoring sound. In some cases it has been determined that the snoring sounds do not occur if and as long as the person concerned sleeps in a particular position, such as lying on his or her side. Fewer people tend to snore when lying on their side, as the soft tissue may not obstruct the airway in the same manner as when the person is lying on his or her back.

German Patent No. 1198005, for example, teaches a device including a padded board having the same length as the upper part of a person's body and which may be hinged along the longitudinal axis of the board. The board may be equipped with a locking device that locks the part of the board that can be lifted up at an angle of between 60 degrees and 90 degrees. Such a device may be equipped at both ends with loops through which one leg and one arm are disposed so that the sleeping person is forced into the side position by the part that is lifted up. This type of device, however, may not be conducive to restful sleep since the sleeping person is pinned in a side position and is not able to turn around.

U.S. Pat. No. 3,089,130 teaches a device adapted to be mounted on a bed in which the head of the sleeping person is put on a head support that can be tilted and is equipped with a vibrator. Snoring sounds are detected by a microphone and are fed as a control signal to a control system that then activates the vibrator. By actuation of the vibrator, the head of the sleeping person is shaken up and down so that he/she wakes up, thereby causing the snoring to cease. Such a device also has the disadvantage of interrupting the sleep of the person, often numerous times throughout the night.

U.S. Pat. No. 4,788,533 teaches a device for interrupting the snoring of a sleeping person as soon as the snoring begins. The device includes a microphone which picks up the snoring noise emitted by an individual and compares the intensity of the snoring noise detected by the microphone to a threshold level. In the event the detected noise is above the threshold, a sound device is actuated which does not awaken the subject, but does subconsciously cause a change in behavior in the subject.

U.S. Pat. No. 4,848,360 discloses a device for preventing the snoring of a sleeping person which again does not wake the person. The device includes a box having a microphone which picks up the snoring noise emitted by an individual and filters out other sounds. In the event the snoring continues for more than a specified period of time, i.e., thirty seconds, a vibrator is actuated which does not awaken the subject, but does influence him/her to change his or her sleeping position.

The use of these devices does not provide that the snorer will change his or her sleeping position to stop the snoring. Therefore there is a need for a bedding product and associated method suitable to stop a person's snoring by changing his or her sleeping position without substantially disturbing his/her sleep.

SUMMARY OF THE INVENTION

These and other problems in the prior art are addressed by this invention which, in one embodiment, includes a bedding product comprising a mattress, a topper above the mattress, and an inflatable bladder assembly located between the mattress and topper, the inflatable bladder assembly comprising two inflatable bladders. The product further comprises a sensor assembly adapted to detect a sound associated with human snoring, and an air supply system operatively coupled to the sensor assembly and adapted to control a supply of air to at least one of the inflatable members. The topper may be made of foam, fiber or springs or any combination thereof.

According to another aspect of the invention, the bedding product comprises a mattress, padding on top of the mattress, at least one inflatable bladder assembly situated between the mattress and the padding, each of the inflatable bladder assemblies comprising at least one fabric sleeve having at least one inflatable member inside the sleeve. The product further comprises a sensor assembly adapted to detect a sound associated with human snoring and an air supply system operatively coupled to the sensor assembly and adapted to control a supply of air to at least one of the inflatable bladder assemblies.

The air supply system of the product may deliver a first supply of air to the first bladder upon a detection of a sound associated with human snoring by the sensor assembly. Upon a second detection of the sound associated with human snoring by the sensor assembly, the first air bladder may deflate and the air supply system may deliver a second supply of air to the second air bladder. When the sensor assembly ceases detecting the sound associated with human snoring, the second air bladder may deflate. The product may be adapted to independently control respective air flow into any of the air inflatable members.

The product may be adapted to independently control respective air flow into any of the air inflatable members. The product may be adapted to receive at least two persons sleeping contemporaneously thereon. The sensor assembly may be adapted to distinguish respective snoring sounds coming from the at least two persons. The air supply system may be configured to respond differently to respective snoring sounds coming from the at least two persons. The air supply system may be adapted to cause deflation of the inflatable members. The inflatable bladders may be movable.

The product may further include a mattress that may be a foam mattress, an air mattress or a mattress comprised of at least some springs or any combination thereof. The mattress may be a pocketed spring mattress, such as the one disclosed in U.S. Pat. No. 7,513,003, which is fully incorporated by reference herein. The present invention is not intended to limit the interior of the mattress. The product may include an upholstered covering surrounding the mattress, topper and inflatable bladder assembly or assemblies.

BRIEF DESCRIPTION OF THE DRAWINGS

These and other objectives and advantages will become readily apparent to those of ordinary skill in the art from the following description of embodiments of the invention and from the drawings in which.

DETAILED DESCRIPTION

Figure 1:
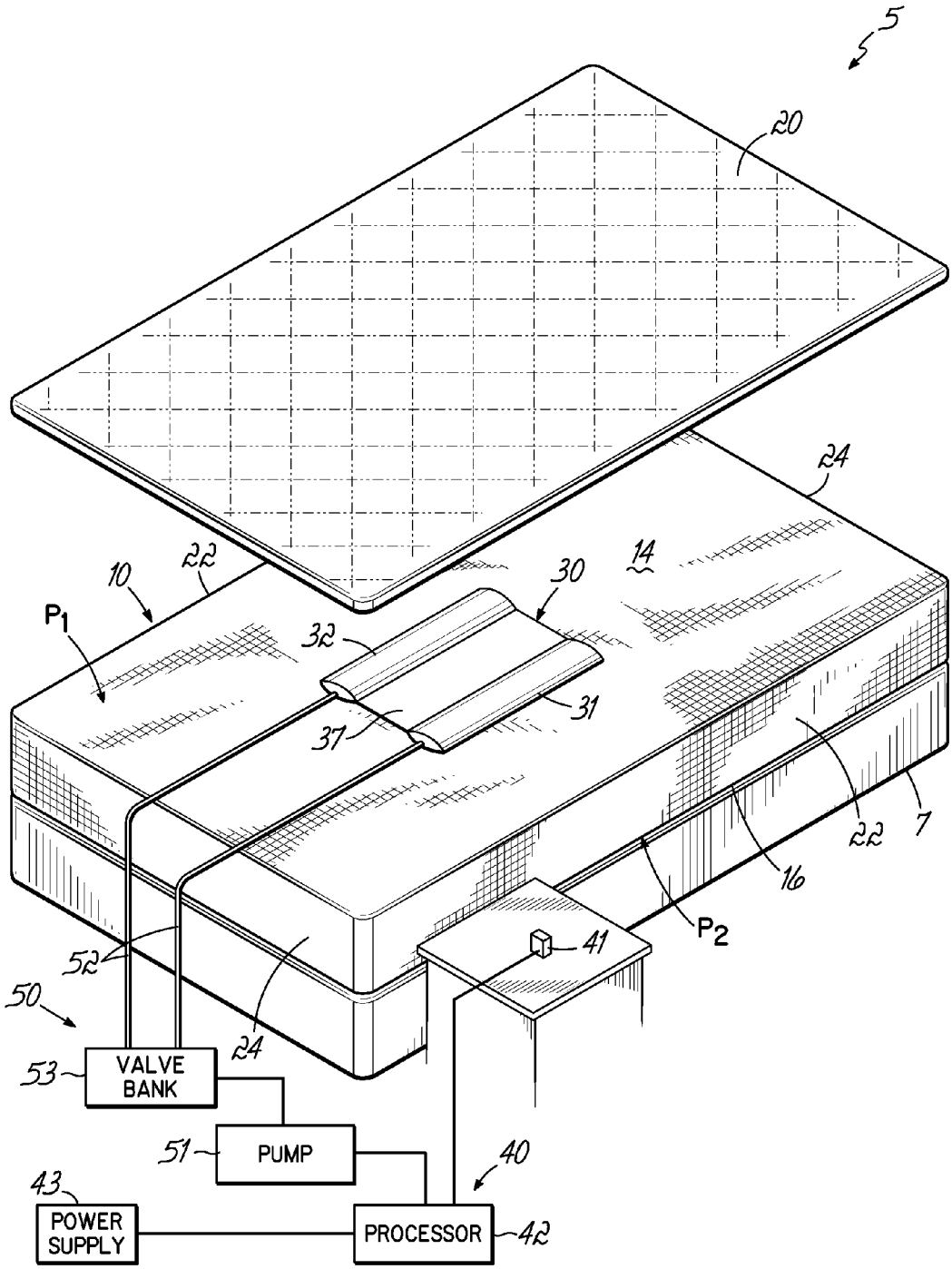
FIG. 1 is a partially disassembled view of a bedding product containing a mattress, a topper, an inflatable bladder assembly, an air supply system and a sensor assembly.

Referring to the drawings, particularly to FIG. 1, a bedding product 5 comprising a mattress 10 is shown on top of a bedding foundation 7. The bedding foundation 7 is not part of the invention and may be any known foundation, such as a box spring. The mattress 10 has a generally planar top surface 14 in a top plane P1 and a parallel generally planar bottom surface 16 in a bottom plane P2. The mattress 10 is not intended to be limited to any particular mattress. It may be comprised of at least some springs (pocketed or unpocketed), fiber, foam, or may be an air mattress or any other type of mattress known to a person skilled in the art.

A topper pad or topper 20 is located on top of mattress 10. As shown in FIG. 1, the topper 20 may be purchased separately from the mattress 10 and replaced as needed. The topper 20 may be secured to the mattress 10 in any known manner, such as with a zipper or hook and loop fasteners (Velcro®). An inflatable bladder assembly 30 is located between the topper 20 and the mattress 10.

Figure 1A:
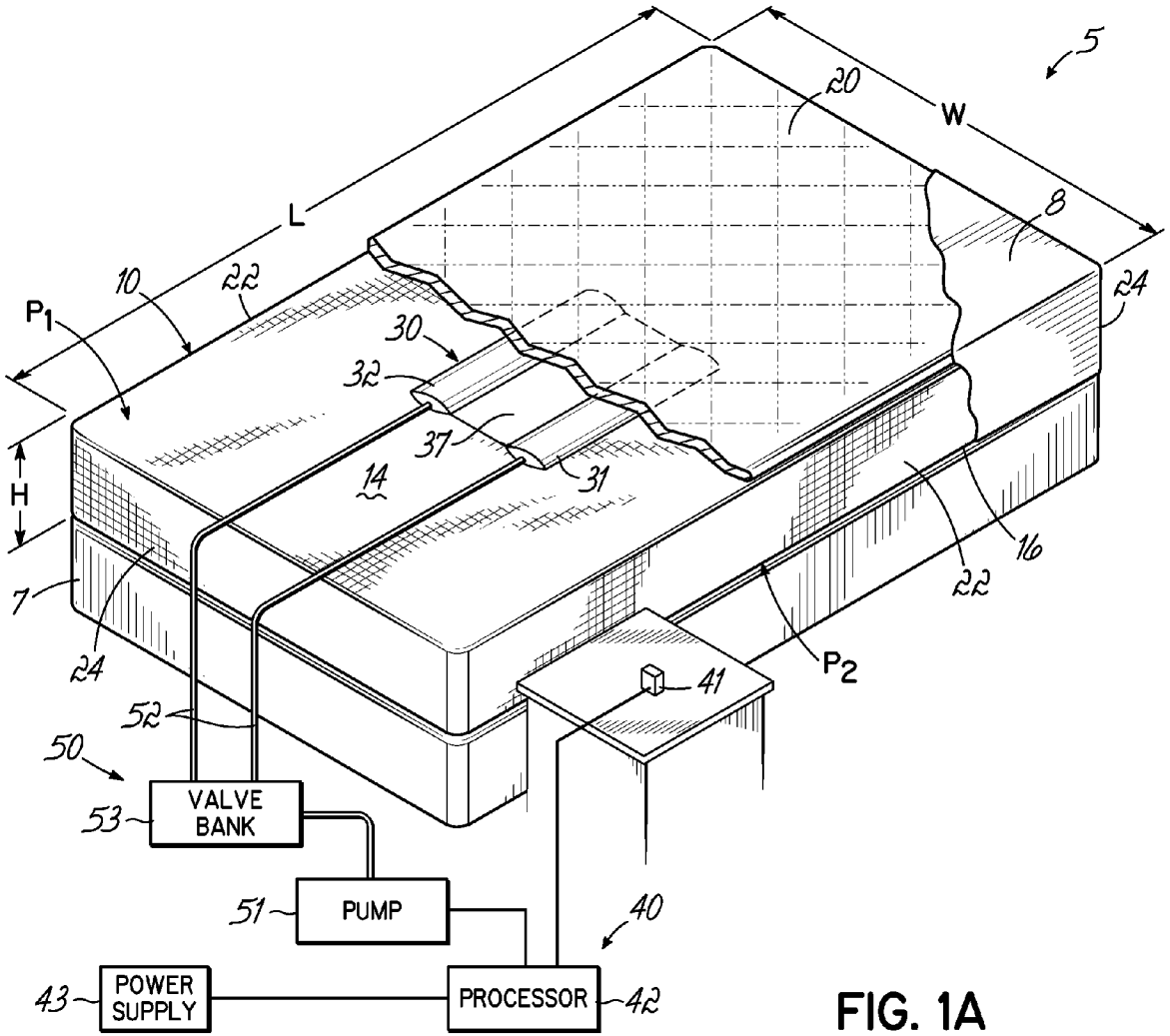
FIG. 1A is a partially disassembled view of the bedding product of FIG. 1 on top of a box spring or foundation.

Alternatively, as shown in FIG. 1A, the topper 20 and an inflatable bladder assembly 30 may be incorporated into the mattress 10. For example, an upholstered covering 8 (shown in FIG. 1A) may encase the mattress 10, topper 20 and inflatable bladder assembly 30.

As shown in FIG. 1A, the bedding product 5 has a height H defined as the distance between the top and bottom surfaces of the covered product 5. Similarly, the product 5 has a transverse dimension or width W defined between opposed side surfaces 22 and a longitudinal dimension or length L defined as the distance between the opposed end surfaces 24 of the product 5. The longitudinal dimension is illustrated as being larger than the transverse dimension of the product 5 although the longitudinal and transverse dimensions may alternatively be identical, such as in a square product.

Figure 2:
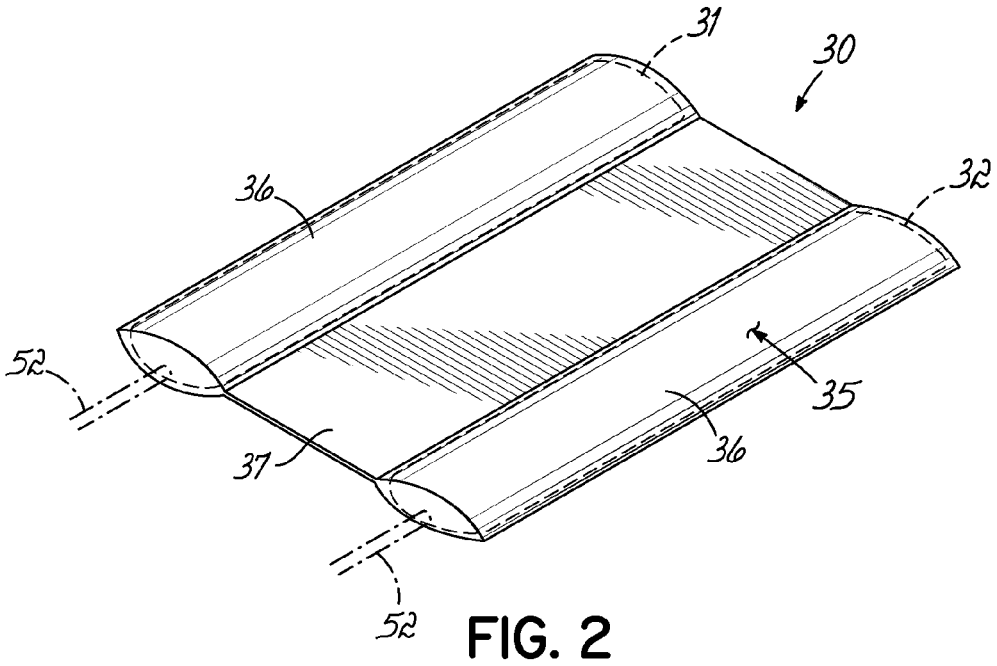
FIG. 2 is a perspective view of an inflatable bladder assembly.
Figure 3:
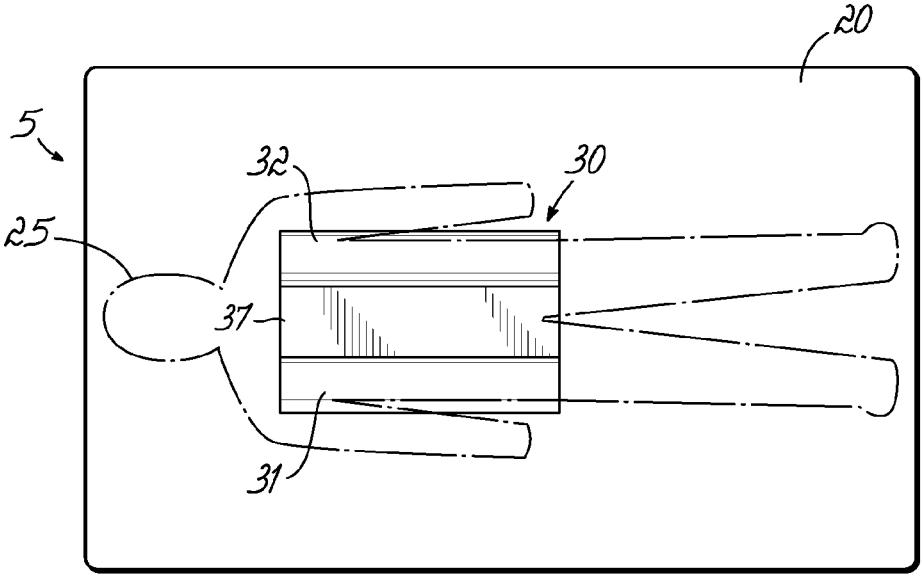
FIG. 3 is a top view of the bedding product of FIG. 1 showing the inflatable bladder assembly and a person lying on the bedding product.

With continued reference to FIG. 1, the bedding product 5 has an inflatable bladder assembly 30 comprising two parallel air bladders 31, 32 inside a fabric sleeve 35. As best shown in FIG. 2, fabric sleeve 35 has two compartments 36 for receiving and retaining air bladders 31, 32 with a separation 37 therebetween. As shown in FIGS. 1 and 1A, air bladders 31, 32 of inflatable bladder assembly 30 are spaced from each other and extend in a longitudinal direction at select locations across the width W of the bedding product 5. As shown in FIG. 3, each of the inflatable pneumatic members or air bladders 31, 32 extends a length approximately between the shoulders and hips of the person 25 lying on the product 5. The length of the air bladders 31, 32 may be varied according to the size of the bed and/or the person anticipated to sleep on the bed. In one embodiment, the width of the inflatable bladder assembly 30 is approximately the width of a person's waist, but also may be varied according to the size of the bed and/or the person intended to sleep on the bed.

Figure 4:
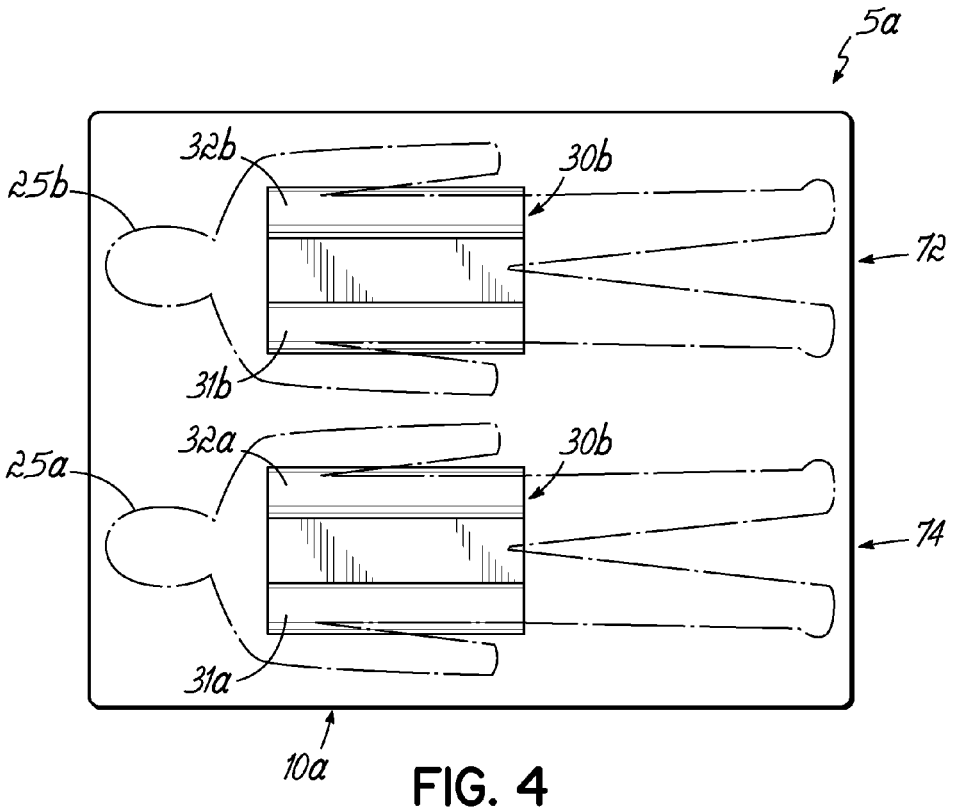
FIG. 4 is a top view of the bedding product showing two inflatable bladder assemblies and two persons lying on the bedding product.

FIG. 4 illustrates a bedding product 5*a* comprising a mattress 10*a* intended for two persons 25*a*, 25*b* and two inflatable bladder assemblies 30*a*, 30*b*. Although four inflatable pneumatic members 31*a*, 32*a*, 31*b* and 32*b* are illustrated in FIG. 4, the bedding product 5*a* may have any number of inflatable pneumatic members at any desired locations. Although this embodiment is illustrated having two inflatable pneumatic members per each of two sections 72, 74 of product 5*a*, the bedding product 5*a* may also be manufactured with any number of inflatable pneumatic members per section and/or include more than two sections.

Referring to FIG. 1, an air supply system 50 generally includes an air pump 50 supplying air to each of the air bladders 31, 32 in bedding product 5 while a sensor assembly 40 controls the functionality and air distribution from the pump 51 into the inflatable bladders 31, 32. FIG. 1 further shows a power supply or source 43 supplying electrical power to the sensor assembly 40 and air pump 51. Air supply lines 52 fluidly connect the air pump 51 to each of the bladders 31, 32.

With continued reference to FIG. 1, sensor assembly 40 comprises a microphone 41 and a processor 43. Microphone 41 is suitable to detect and distinguish sounds, such as those produced by conventional human snoring. Microphone 41 is positioned proximate bedding product 5 to detect sounds 6 made by a person 25 lying on bed 10. Processor 42 is suitably connected to microphone 41, such that processor 42 may receive a signal from microphone 41 and send, when a specific set of logic conditions is met, respective electric signals to an air pump 51 and to a set of valves 53 located between air pump 51 and air bladders 31, 32.

In one aspect of this embodiment, valves 53 independently control air flow to each of the bladders 31 and 32, such that a specific set of instructions from processor 42 may, for example, include inflating each of the bladders 31, 32 to a different degree or, alternatively inflating some of the bladders while not inflating others. Alternatively, valves 53 may jointly (i.e., not independently) control all of the inflatable bladders in one specific section of bed 5 so that a set of instructions may comprise, for example, inflating both bladders 31*a*, 32*a* of bed 5 while maintaining both of the bladders 31*b*, 32*b* in a deflated condition or inflated to a different level relative to bladders 31*a*, 32*a*. A remote control unit (not pictured) may permit, for example, calibration of the processor 42 to different sounds received by the microphone 41 and programming of the reaction to a specific set of sounds. A remote control unit may further allow individual or joint energizing and deenergizing of the microphone 41, processor 42, air pump 51 or valves 53 to block or override their automated operation, if desired.

Although four bladders 31*a*, 32*a*, 31*b* and 32*b* are depicted (see FIG. 4), the product 5 may have any number of bladders or other type of inflatable pneumatic members at any desired locations. Although one configuration of bladders 31*a*, 32*a*, 31*b* and 32*b* is depicted, the bladders 31*a*, 32*a*, 31*b* and 32*b* may assume other shapes and configurations. The bladders 31*a*, 32*a*, 31*b* and 32*b* may be constructed from a variety of materials, such as neoprene, butyl rubber and the like. Optionally, the bladders 31*a*, 32*a*, 31*b* and 32*b* may be covered exteriorly with a cloth cover (not shown) to reduce noise resulting from their operation or interaction with springs, such as squeaking. Air supply system 50 controls the flow of air via air supply lines 52 fluidly connected to each of the bladders 31*a*, 32*a*, 31*b* and 32*b*. An air pump 51 powered by a power source 43 provides air through the supply line 52 to the bladders 31*a*, 32*a*, 31*b* and 32*b*.

FIG. 4 illustrates an exemplary position of two individuals 25*a*, 25*b* lying on product 5*a* and an exemplary length of inflatable members 31*a*, 32*a*, 31*b* and 32*b*. Two bladders 31*a*, 32*b* lie under one side of a person 25*a*. Two bladders 31*b* and 32*b* lie under the other side of another person 25*b*. Bladders 31*a*, 32*a*, 31*b* and 32*b* may have a length substantially shorter than length L of mattress 10 and be longitudinally located proximate the torso of a person. While FIG. 4 depicts bladders 31*a*, 32*a*, 31*b* and 32*b* of a length substantially shorter than the length L of mattress 10, bladders 31*a*, 32*a*, 31*b* and 32*b* may alternatively have any suitable length, such that the bladders may exert a sufficient force against a selected portion of a person when inflated. Bladders 31*a*, 32*a*, 31*b* and 32*b* may, for example, have a length substantially equal to that length L of mattress 10.

Figure 5A:
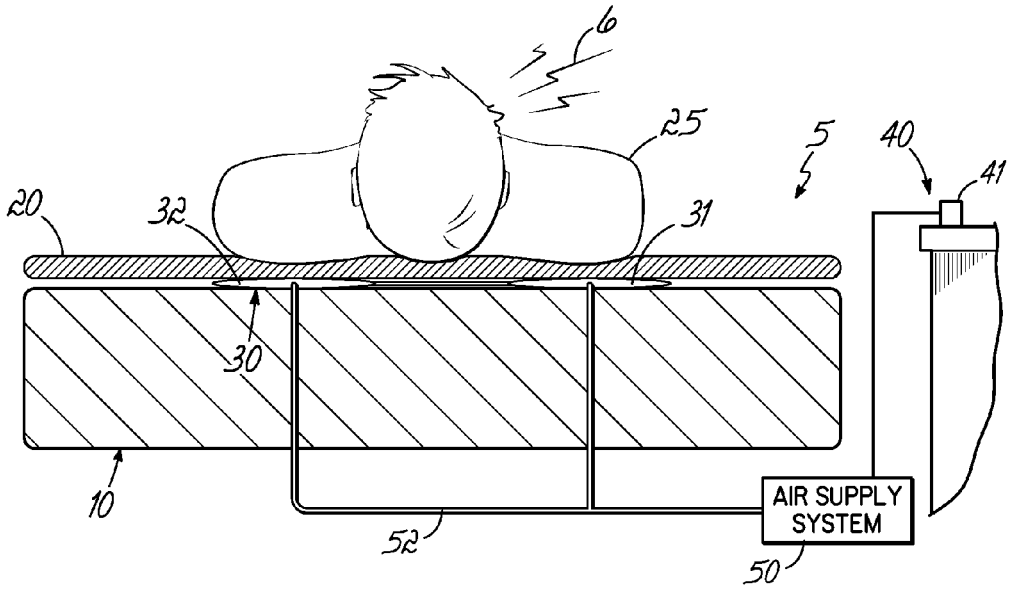
FIG. 5A is cross-sectional view of the product shown in FIG. 3 with all inflatable members deflated.
Figure 5B:
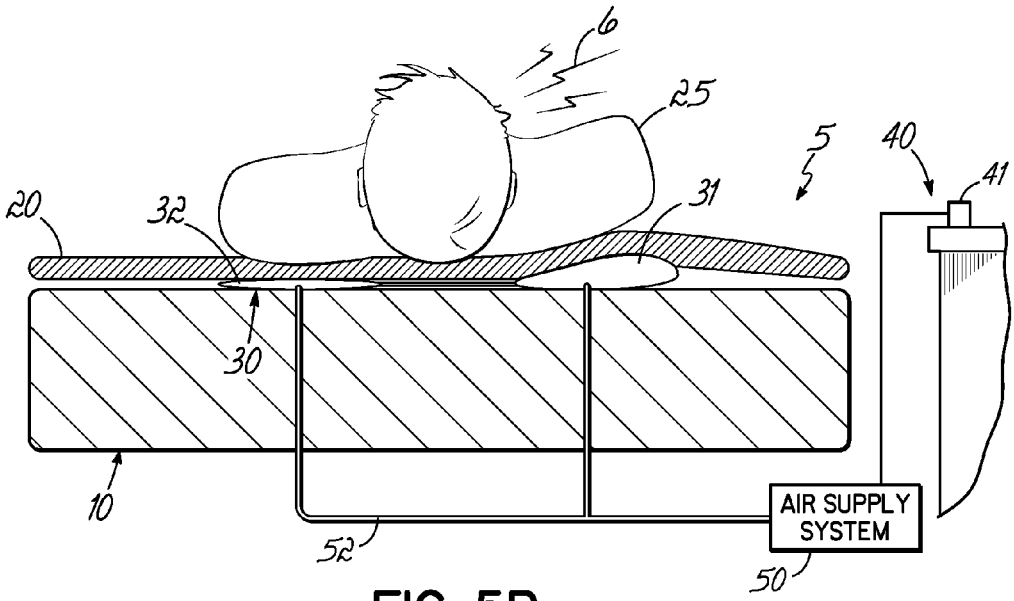
FIG. 5B is a cross-sectional view of the product shown in FIG. 3 showing a first inflatable member in an inflated condition.

With reference to FIGS. 5A-5E, the three conditions of bladders 31*a*, 32*a*, 31*b* and 32*b* depicted in FIG. 4 are shown along with their intended effect on a person 25 sleeping on product 5. FIG. 5A shows person 25 sleeping, face up, generally centered across the width W of product 5 and bladders 31 and 32 in a deflated condition. Symbolically depicted sensor assembly 40 may detect a snoring sound 6 coming from person 25. Upon recognizing the sound, sensor assembly 40 may send respective signals to air pump 51 and one or more of valves 53 (FIG. 1) of air supply system 50 to inflate one or more of the bladders 31, 32. FIG. 5B shows an exemplary event, in which the processor or controller 42 has sent signals, as described above, to valves 53 to cause air to flow into and thereby inflate bladder 31, while maintaining bladder 32 in a deflated condition.

Figure 5C:
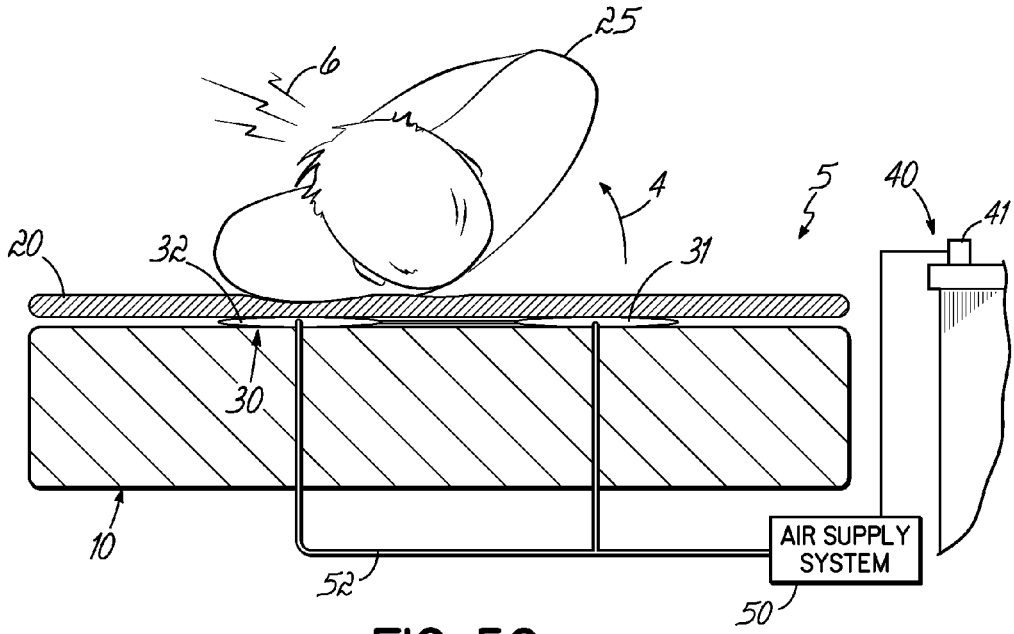
FIG. 5C is cross-sectional view of the product shown in FIG. 3 showing a person rolling over in response to the inflatable member in the inflated condition.

With reference to FIGS. 5B and 5C, inflation of bladder 31 causes an upward motion of a portion of the topper 20 of product 5, thereby creating a bump and inducing person 25 to at least partially rotate from his original position depicted in FIG. 5A, in the general direction of arrow 4.

Figure 5D:
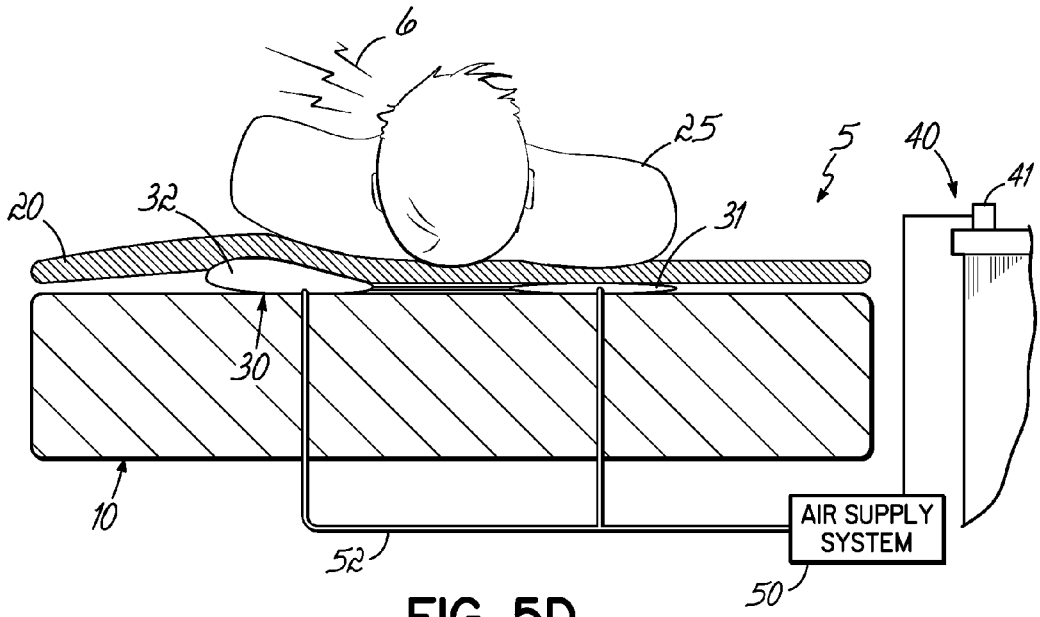
FIG. 5D is a cross-sectional view of the product shown in FIG. 3 showing a second inflatable member in an inflated condition.
Figure 5E:
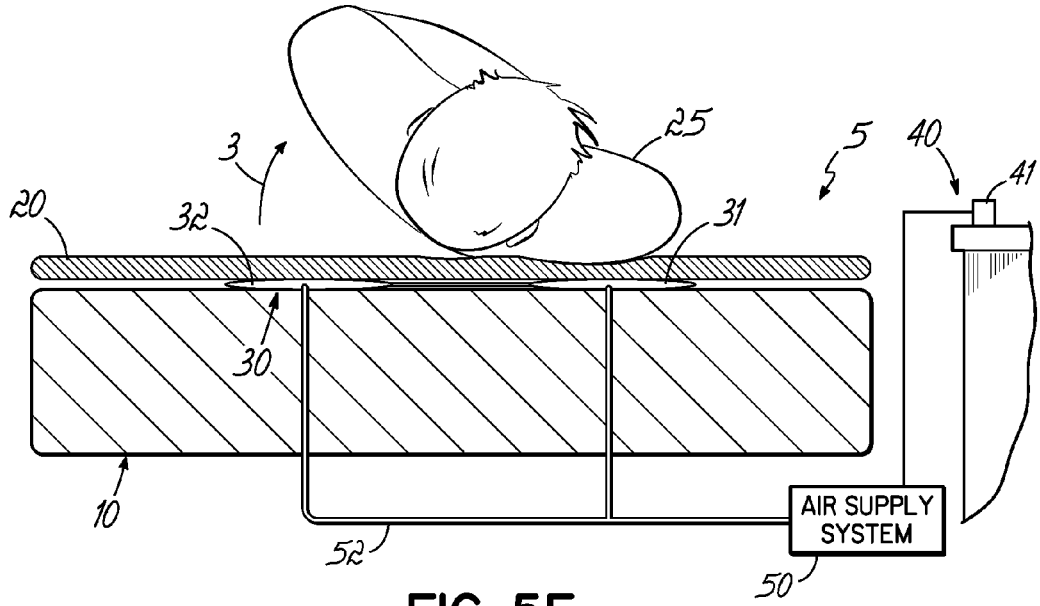
FIG. 5E is a cross-sectional view of the product shown in FIG. 3 showing a person rolling over in response to the inflatable member in the inflated condition.

FIGS. 5D and 5E show another exemplary event, in which, upon recognizing a snoring sound, sensor assembly 40 has sent signals to the controller 42, as described above, which controls valves 53 to control flow of air into inflatable bladder 32 of product 5, while maintaining bladder 31 in a deflated condition. Inflation of bladder 32 causes an upward motion of a portion of the padding 20 and upholstery (not shown) of product 5, thereby creating a bump and inducing person 25 to at least partially rotate from his original position depicted in FIG. 5A, in the general direction of arrow 3.

The embodiment of FIGS. 5A-5E depicts an operation in which only one bladder, such as bladder 31, is inflated at a time. Persons of ordinary skill in the art will recognize that multiple bladders may be inflated at once and that the bladders may be inflated to a different degree or level from that depicted herein. In an embodiment containing more than two inflatable bladder assemblies or more than a first and second air bladder per assembly, for example, one bladder may be inflated to 50% of its capacity, while the remaining bladder may be inflated to 80% of its capacity. In another aspect of this embodiment, sensor assembly 40 may send corresponding signals to the air supply system 50 to bleed the bladders 31, 32 from an inflated condition, thereby returning product 5 to its original, horizontal condition as best depicted in FIG. 5A.

With reference to FIG. 4, an alternative embodiment of a product 5*a* of a width greater than width W of product 5 may, for example, correspond to what is commonly known in the art as a "queen size" bed or alternatively a "king size" bed. Product 5*a* is wide enough to hold more than one person, such as persons 25*a*, 25*b* and may include two pairs of bladders 31*a*, 32*a*, 31*b* and 32*b* disposed in a fashion similar to that of product 5, wherein each pair lies below one side of a torso of each person 25*a*, 25*b*. Sensor assembly 40 (as seen in FIG. 1) controls air supply system 50, which controls flow of air into and out of bladders 31*a*, 32*a*, 31*b* and 32*b*. A sensor assembly 40 may be capable of recognizing two distinct sets of snoring sounds associated with each of the two persons 25*a*, 25*b* that sleep on product 5. Upon recognizing a snoring sound 6 coming, for example, from person 25*a*, such sensor assembly would send respective signals to air supply system 50 to cause inflation of respective bladder supporting a section of the mattress 10 where person 25*a* normally sleeps. Alternatively, sensor assembly 40 may comprise two microphones (not shown) respectively, located proximate each person 25*a*, 25*b* and connected to one or more processors (not shown), such that each microphone corresponds to one specific set of bladders associated with a section of the mattress 10. In such an alternative embodiment, the sensor assembly 40 would not be required to recognize the snoring sound of a specific person 25*a*, 25*b* over the other, nor would it be required to send a signal to air supply system 40 to inflate a specific bladder under padding 20 over which a specific person is expected to lie.

Accordingly, many further embodiments, applications and modifications of the invention will become readily apparent to those of ordinary skill in the art without departing from the scope of the invention which is defined by the claims appended hereto.

What is claimed is:

1. A bedding product comprising:

a mattress having a generally planar top surface;

a removable topper above the mattress;

at least one movable inflatable bladder assembly located between the generally planar top surface of the mattress and topper, each inflatable bladder assembly comprising multiple parallel inflatable bladders, each inflatable bladder being inside a compartment of a sleeve, the compartments being spaced apart and connected by a connector;

a sensor assembly adapted to detect a sound associated with human snoring; and an air supply system operatively coupled to said sensor assembly and adapted to control a supply of air to at least one of said inflatable bladders wherein inflation of one of the inflatable bladders raises a portion of the topper, creating a bump and inducing a person to change position.

2. The product of claim 1 wherein said product has only one inflatable bladder assembly comprising a first air bladder and a second air bladder.

3. The product of claim 1 wherein said mattress is foam.

4. The product of claim 1 wherein said mattress comprises at least some springs.

5. The product of claim 1 wherein said mattress is an air mattress.

6. The product of claim 1 wherein said product has two inflatable bladder assemblies, each comprising multiple inflatable air bladders.

7. The product of claim 2 wherein said air supply system delivers a first supply of air to said first air bladder upon a first detection of a sound associated with human snoring by said sensor assembly;

wherein upon a second detection of the sound associated with human snoring by said sensor assembly, said first air bladder deflates and said air supply system delivers a second supply of air to said second air bladder wherein said sensor assembly ceases detecting the sound associated with human snoring, said second air bladder deflates.

8. The product of claim 1 wherein said air supply system is adapted to independently control respective air flow into any of said air inflatable bladders.

9. The product of claim 1 wherein said bedding product is adapted to receive at least two persons sleeping contemporaneously thereon.

10. The product of claim 9 wherein said sensor assembly is adapted to distinguish respective snoring sounds coming from the at least two persons.

11. The product of claim 9 wherein said air supply system is configured to respond differently to respective snoring sounds coming from the at least two persons.

12. The product of claim 1 wherein said product has two inflatable bladder assemblies.

13. The product of claim 1 wherein said air supply system is adapted to cause deflation of said inflatable members.

14. A bedding product comprising:

a mattress having a generally planar top surface;

padding on top of the top surface of the mattress, said padding being separable from the mattress;

at least one inflatable bladder assembly situated between the top surface of the mattress and the padding, each of the inflatable bladder assemblies comprising multiple inflatable bladders, each inflatable bladder being inside a compartment of a sleeve, the compartments being spaced apart and connected by a connector;

a sensor assembly adapted to detect a sound associated with human snoring; and an air supply system operatively coupled to said sensor assembly and adapted to control a supply of air to each inflatable bladder assembly wherein inflation of at least one of the inflatable members raises a portion of the padding, creating a bump and inducing a person to change position.

15. The product of claim 14 wherein each fabric sleeve contains a first and second inflatable bladder.

16. The product of claim 14 wherein said mattress is foam.

17. The product of claim 14 wherein said mattress comprises at least some springs.

18. The product of claim 14 wherein said mattress is an air mattress.

19. The product of claim 15 wherein said air supply system delivers a first supply of air to said first air bladder upon a first detection of a sound associated with human snoring by said sensor assembly;

wherein upon a second detection of the sound associated with human snoring by said sensor assembly, said first air bladder deflates and said air supply system delivers a second supply of air to said second air bladder wherein said sensor assembly ceases detecting the sound associated with human snoring, said second air bladder deflates.

20. The product of claim 14 wherein said air supply system is adapted to independently control respective air flow into any of said inflatable members.

21. The product of claim 14 wherein said air supply system is adapted to independently control respective air flow into any of said inflatable members.

22. The product of claim 14 wherein said bedding product is adapted to receive at least two persons sleeping contemporaneously thereon.

23. The product of claim 21 wherein said sensor assembly is adapted to distinguish respective snoring sounds coming from the at least two persons.

24. The product of claim 21 wherein said air supply system is configured to respond differently to respective snoring sounds coming from the at least two persons.

25. The product of claim 14 wherein said at least one air bladder assembly is movable.

26. The product of claim 14 wherein said air supply system is adapted to cause deflation of said inflatable members.

27. A bedding product comprising:

a mattress having a generally planar top surface;

a topper above the mattress, the topper being removable from the mattress;

at least one movable inflatable bladder assembly located between the generally planar top surface of the mattress and topper, each inflatable bladder assembly comprising multiple parallel inflatable bladders, each inflatable bladder being inside a compartment of a sleeve, the compartments being spaced apart and connected by a connector;

a sensor assembly adapted to detect a sound associated with snoring; and an air supply system operatively coupled to said sensor assembly and adapted to control a supply of air to at least one of said inflatable bladders wherein inflation of one of the inflatable bladders raises a portion of the topper, creating a bump in the topper.

* * * * *

UNITED STATES PATENT AND TRADEMARK OFFICE

CERTIFICATE OF CORRECTION

PATENT NO. : 8,832,887 B2
APPLICATION NO. : 13/953127
DATED : September 16, 2014
INVENTOR(S) : Niels S. Mossbeck It is certified that error appears in the above-identified patent and that said Letters Patent is hereby corrected as shown below:

In the Specification

Column 3

Line 26, "is cross-sectional" should be --is a cross-sectional--.

Line 31, "is cross-sectional" should be --is a cross-sectional--.

In the Claims

Column 7

Line 23, "said sensor" should be --when said sensor--.

Column 8

Line 16, "said sensor" should be --when said sensor--.

Signed and Sealed this
Twenty-fourth Day of February, 2015

Michelle K. Lee

Michelle K. Lee
*Deputy Director of the United States Patent and Trademark Office*